US011753212B2

(12) United States Patent
Song

(10) Patent No.: US 11,753,212 B2
(45) Date of Patent: Sep. 12, 2023

(54) SEPARABLE BEVERAGE FRESHNESS PRESERVER

(71) Applicant: ZHUHAI CHEER TECHNOLOGY CO., LTD, Guangdong (CN)

(72) Inventor: Xiaoxian Song, Guangdong (CN)

(73) Assignee: ZHUHAI CHEER TECHNOLOGY CO., LTD, Zhuhai (CN)

( * ) Notice: Subject to any disclaimer, the term of this patent is extended or adjusted under 35 U.S.C. 154(b) by 0 days.

(21) Appl. No.: 17/564,309

(22) Filed: Dec. 29, 2021

(65) Prior Publication Data

US 2022/0119162 A1 Apr. 21, 2022

Related U.S. Application Data

(63) Continuation of application No. PCT/CN2019/112741, filed on Oct. 23, 2019.

(30) Foreign Application Priority Data

Jul. 25, 2019 (CN) ..... 201910674717.7

(51) Int. Cl.
*B65D 39/12* (2006.01)
*B65D 47/06* (2006.01)
(Continued)

(52) U.S. Cl.
CPC ..... *B65D 39/12* (2013.01); *B65D 47/068* (2013.01); *B65D 53/02* (2013.01);
(Continued)

(58) Field of Classification Search
CPC .. B67D 1/0412; B67D 1/0418; B67D 1/0437; B65D 39/12; B65D 47/068; B65D 81/2076
See application file for complete search history.

(56) References Cited

U.S. PATENT DOCUMENTS 478,940 A * 7/1892 Ogram ..... B05B 11/048 222/401
968,736 A * 8/1910 Brent ..... B67D 1/0412 222/399

(Continued)

FOREIGN PATENT DOCUMENTS

EP 2727878 A1 * 5/2014 ..... B67D 1/0412

OTHER PUBLICATIONS

International Search Report of PCT Patent Application No. PCT/CN2019/112741 dated Apr. 23, 2020.

*Primary Examiner* — Paul R Durand
*Assistant Examiner* — Randall A Gruby

(57) ABSTRACT

This invention discloses a separable beverage freshness preserver including a gas outlet assembly and a sealing assembly connected with the gas outlet assembly. The separable beverage freshness preserver is characterized in that the sealing assembly includes a liquid guiding assembly and a bottle stopper assembly connected with the liquid guiding assembly; the liquid guiding assembly includes a cock and a liquid dispensing pipe connected with the cock; and the liquid dispensing pipe is detachably connected with the cock. The liquid dispensing pipe and the like can be separated from a bottle body, and thus, beverages can be placed in a place with a narrow space, such as a refrigerator and the like, and occupy a small space so as to facilitate refrigeration and preservation of beverages.

9 Claims, 12 Drawing Sheets

(51) Int. Cl.

| | |
|---|---|
| ***B65D 53/02*** | (2006.01) |
| ***B65D 81/20*** | (2006.01) |
| ***B65D 81/24*** | (2006.01) |
| ***B65D 85/72*** | (2006.01) |
| ***B67D 1/04*** | (2006.01) |

(52) U.S. Cl.
CPC ..... *B65D 81/2076* (2013.01); *B65D 81/24* (2013.01); *B65D 85/72* (2013.01); *B67D 1/0412* (2013.01); *B67D 1/0418* (2013.01)

(56) References Cited

U.S. PATENT DOCUMENTS

| | | | | | |
|---|---|---|---|---|---|
| 2,172,035 | A * | 9/1939 | Roth | B01F 23/23611 | 261/DIG. 7 |
| 2,367,077 | A * | 1/1945 | Ward | B67D 1/0418 | 222/400.7 |
| 2,552,857 | A * | 5/1951 | Knapp | B65D 83/663 | 222/320 |
| 2,596,414 | A * | 5/1952 | Knapp | B67D 1/0418 | 239/573 |
| 3,679,104 | A * | 7/1972 | Giroud | B67D 1/0418 | 222/396 |
| 4,392,578 | A * | 7/1983 | Fipp | B65D 81/2076 | 222/401 |
| 5,443,186 | A * | 8/1995 | Grill | B67D 1/0418 | 137/505.11 |
| 5,458,165 | A * | 10/1995 | Liebmann, Jr. | B65B 31/04 | 261/DIG. 7 |
| 9,227,827 | B1 | 1/2016 | Scott | | |
| 10,815,113 | B2 * | 10/2020 | Lambrecht | B67D 1/1252 | |
| 2009/0224000 | A1 * | 9/2009 | Lopez | B67D 1/0418 | 222/399 |

* cited by examiner

SEPARABLE BEVERAGE FRESHNESS PRESERVER

CROSS REFERENCE TO RELATED APPLICATIONS

The present application is a Continuation Application of PCT Application No. PCT/CN2019/112741 filed on Oct. 23, 2019, which claims the benefit of Chinese Patent Application No. 201910674717.7 filed on Jul. 25, 2019. All the above are hereby incorporated by reference in their entirety.

TECHNICAL FIELD

This invention relates to a separable beverage freshness preserver.

BACKGROUND

Currently, for most of gas beverage freshness preservers, a nitrogen gas outlet device is placed on a bottle stopper, the gas outlet device and the bottle stopper are sealed, the bottle stopper and a beverage bottle are sealed, and the bottle stopper and a liquid guiding pipe are sealed so as to achieve the sealing effect. The nitrogen gas outlet device and the liquid guiding pipe cannot be separately taken down, otherwise sealing is failed. In addition, such one set of gas outlet device can only be used for one bottle of beverage and cannot be reused. For example, a freshness preserver as shown in FIG. 1 includes a gas outlet device assembly 1, a liquid guiding pipe 2, a sealing ring 3, a bottle stopper main body 4, a sealing plug 5 and a dustproof cover 6; and in the sealing process, the gas outlet device assembly 1 and the liquid guiding pipe 2 cannot be taken down, the reasons are as follows, firstly, when the gas outlet device assembly 1 and the liquid guiding pipe 2 are taken down, the sealing is failed, and then a beverage cannot be preserved in a sealed mode; secondly, for sealed preservation, a large storage space is integrally occupied, which is not conducive to refrigeration of the beverage; and thirdly, in the prior art, the freshness preserver has a relatively large volume and weight, and when the beverage in the beverage bottle is reduced, the weight of the whole set of device cannot be supported and the risk of dumping is easy to occur.

SUMMARY

The technical problem solved by the invention is to provide a separable beverage freshness preserver for prolonging the guarantee period of a beverage after the beverage is unsealed and enabling the beverage to be instantly drunk as required.

In order to fulfill the objective above, the invention discloses a separable beverage freshness preserver including a gas outlet assembly and a sealing assembly connected with the gas outlet assembly. The separable beverage freshness preserver is characterized in that the sealing assembly includes a liquid guiding assembly and a bottle stopper assembly connected with the liquid guiding assembly; the liquid guiding assembly includes a cock and a liquid dispensing pipe connected with the cock; and the liquid dispensing pipe is detachably connected with the cock.

Preferably, the cock is provided with a liquid dispensing passage, and one end of the liquid dispensing pipe is detachably arranged in the liquid dispensing passage; a liquid outlet passage is arranged in the cock, and the liquid dispensing passage communicates with the liquid outlet passage; and the cock is further provided with a gas guiding passage, a gas inlet passage and a gas guiding hole communicating with the gas guiding passage, and the lower end of the gas guiding passage is connected with the gas inlet passage.

Preferably, the gas outlet assembly includes a gas outlet bottle and a gas outlet pipe connected with the gas outlet bottle, and the gas outlet pipe is detachably connected with the upper end of the gas guiding passage via the gas guiding hole; and the gas outlet bottle further includes a gas outlet bottle body filled with gas and an inflating part, the inflating part is squeezed into the gas outlet bottle body, and a handle is also arranged on the upper side of the inflating part.

Preferably, the liquid outlet passage, the liquid dispensing passage and the gas inlet passage are integrally formed; and a sealing device is also arranged at the end portion, in contact with the liquid dispensing passage, of the liquid dispensing pipe.

Preferably, the cock is a chamber formed by combining an upper cover, an upper screw cap and a lower cock from top to bottom, and the liquid dispensing passage, the liquid outlet passage, the gas guiding passage and the gas inlet passage are all arranged in the chamber of the cock; the gas guiding passage is arranged in the upper screw cap; and the lower cock is also provided with a through pipe, and the liquid dispensing passage and the liquid dispensing pipe are detachably connected inside the through pipe.

Preferably, the bottle stopper assembly includes a bottle stopper main body, a gas inlet duct and a liquid outlet duct which are connected with the bottom of the bottle stopper main body, and a connector arranged inside the bottle stopper main body.

Preferably, the bottle stopper main body structurally includes a dustproof cover, an upper plate and a lower bottle stopper from top to bottom, the connector is arranged in a cavity surrounded by the upper plate and the lower bottle stopper, the lower end portion of the lower bottle stopper is a cylindrical pipeline, the liquid outlet duct is arranged in the cylindrical pipeline, and the part of the cylindrical pipeline where the liquid outlet duct is removed is the gas inlet duct; and the middle portion of the lower bottle stopper is of a plate body structure, and a gas inlet hole and a liquid outlet hole are arranged at the middle portion of the lower bottle stopper and respectively and correspondingly communicate with the gas inlet duct and the liquid outlet duct.

Preferably, the connector is of an integrally formed structure, and on one side close to the upper plate, further includes a gas passing pipe and a liquid passing pipe which communicate up and down; the upper ends of the gas passing pipe and the liquid passing pipe are respectively and detachably connected with the bottoms of the gas inlet passage and the liquid outlet passage of the liquid guiding assembly; and a sealing device is arranged on the surfaces, respectively connected with the gas inlet passage and the liquid outlet passage, of the gas passing pipe and the liquid passing pipe.

Preferably, a sealing device is arranged at the positions of the gas inlet hole and the liquid outlet hole; the connector further includes a side plate and a bottom plate, a spring is arranged on the periphery of the side plate, and one end of the spring abuts against the upper plate, while the other end abuts against the bottom plate of the connector; and a sealing plug is arranged on the periphery of a cylindrical barrel of the lower bottle stopper.

Preferably, a sealing device is arranged at the positions of the gas inlet hole and the liquid outlet hole; a pressure part is also sleeved with the lower bottle stopper, and one end of the pressure part abuts against the upper plate, while the other end abuts against the bottom of the connector; and a sealing plug is arranged on the periphery of a cylindrical barrel of the lower bottle stopper.

According to the invention, the gas outlet assembly, the gas dispensing pipe and the cock can be separated from the bottle body, and thus, the beverage can be placed in a place with a narrow space, such as a refrigerator and the like, and occupies a small space so as to facilitate refrigeration and preservation, and in addition, the gas inlet hole and the liquid outlet hole of the bottle stopper assembly can be opened and closed along with rotation of the liquid guiding assembly so as to achieve an effect that the beverage is instantly drunk as required. The operation is convenient and rapid and the beverage is easy to preserve; and further, the separable beverage freshness preserver can be reused.

Figure 1:
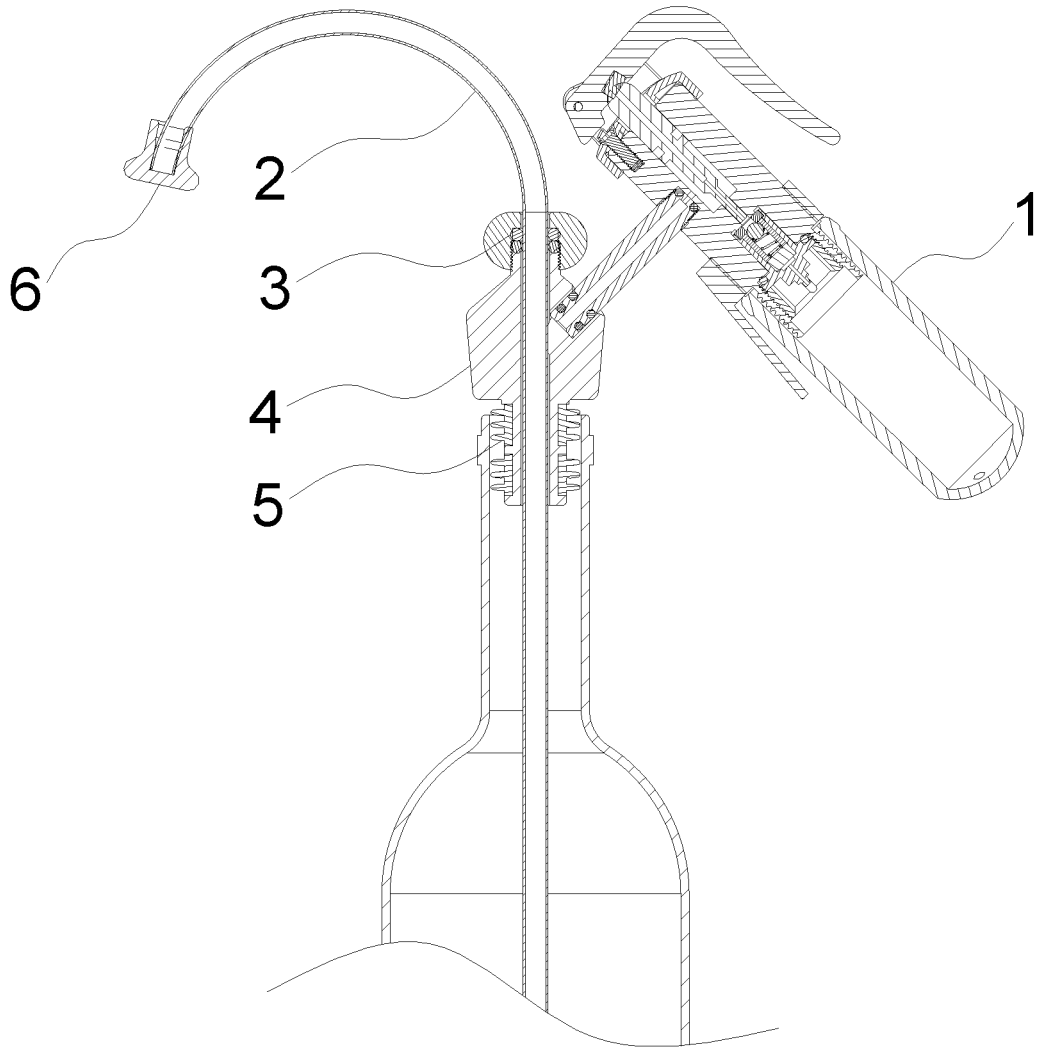
Fig. 1 (Prior Art)
FIG. 1 shows the section view of a beverage freshness preserver in the prior art.

Wherein, 1—gas outlet assembly, 11—gas outlet bottle, 111—gas outlet bottle body, 112—inflating part, 1121—handle, and 12—gas outlet pipe;

2—liquid guiding assembly, 21—cock, 211—liquid dispensing passage, 212—liquid outlet passage, 213—gas guiding passage, 214—gas inlet passage, 215—gas guiding hole, 216—upper cover, 217—upper screw cap, 218—lower cock, 2181—through pipe, and 22—liquid dispensing pipe;

3—bottle stopper assembly, 31—bottle stopper main body, 311—dustproof cover, 312—upper plate, 313—lower bottle stopper, 314—spring, 3131—gas inlet hole, 3132—liquid outlet hole, 32—gas inlet duct, 33—liquid outlet duct, 34—connector, 341—gas passing pipe, 342—liquid passing pipe, 343—side plate, and 344—bottom plate;

4—sealing device;

5—sealing plug; and

6—bottle body.

DETAILED DESCRIPTION

In the description of the invention, directional or positional relationships shown by terms such as "upper", "lower", "front", "rear" and the like are directional or positional relationships shown as in the drawings, which only means to facilitate description of the invention, but do not require that the invention must be constructed or operated in the specific directions, and thus should not be understood as limitation to the invention.

Specific embodiments of the invention will be further illustrated below in combination of the drawings.

Embodiment 1

This embodiment provides a separable beverage freshness preserver for prolonging the guarantee period of a beverage after the beverage is unsealed and enabling the beverage to be instantly drunk as required.

Figure 2:
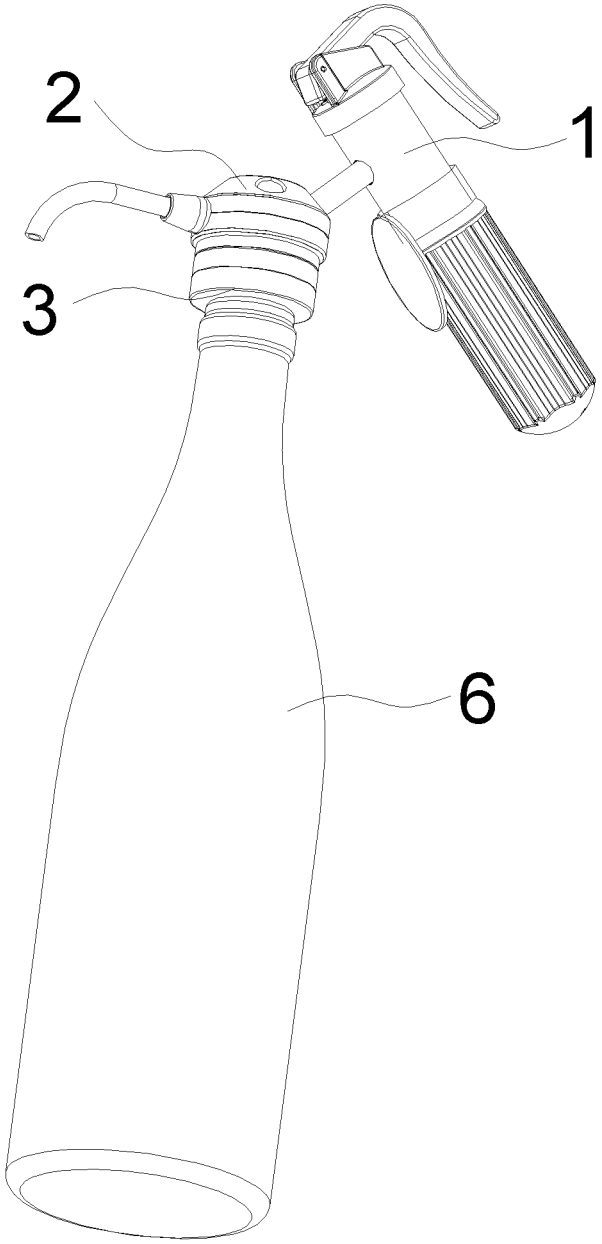
FIG. 2 shows the stereoscopic diagram of a separable beverage freshness preserver according to Embodiment 1 of the invention.

As shown in FIG. 2, the freshness preserver includes a gas outlet assembly 1 and a sealing assembly connected with the gas outlet assembly 1, and the sealing assembly includes a liquid guiding assembly 2 and a bottle stopper assembly 3 connected with the liquid guiding assembly.

Figure 3:
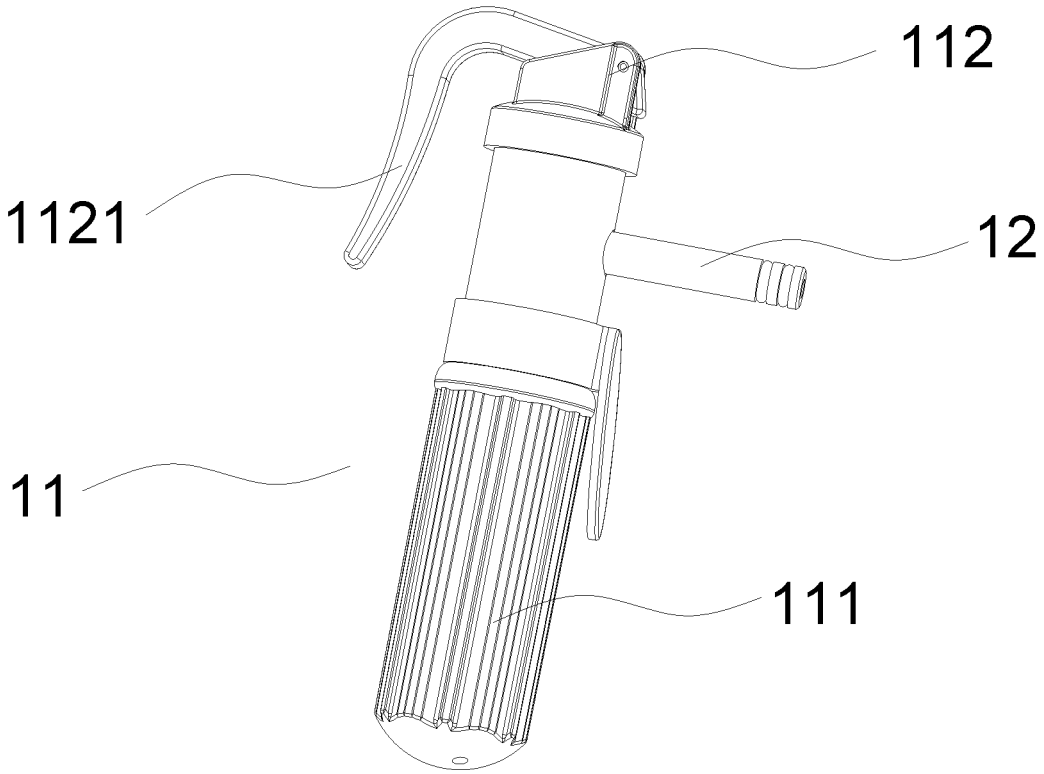
FIG. 3 shows the stereoscopic diagram of a gas outlet assembly of the separable beverage freshness preserver according to Embodiment 1 of the invention.

As shown in FIG. 3, the gas outlet assembly 1 includes a gas outlet bottle 11 and a gas outlet pipe 12 connected with the gas outlet bottle 11, the gas outlet bottle 11 includes a gas outlet bottle body 111 filled with inert gas and an inflating part 112, the inflating part 112 is squeezed into the gas outlet bottle body 111 to prevent the inert gas in the gas outlet bottle body 111 from being leaked, a handle 1121 is also arranged on the upper side of the inflating part 112, and when the handle 1121 is pressed down, the inert gas in the gas outlet bottle body 111 is discharged through the gas outlet pipe 12.

Figure 4:
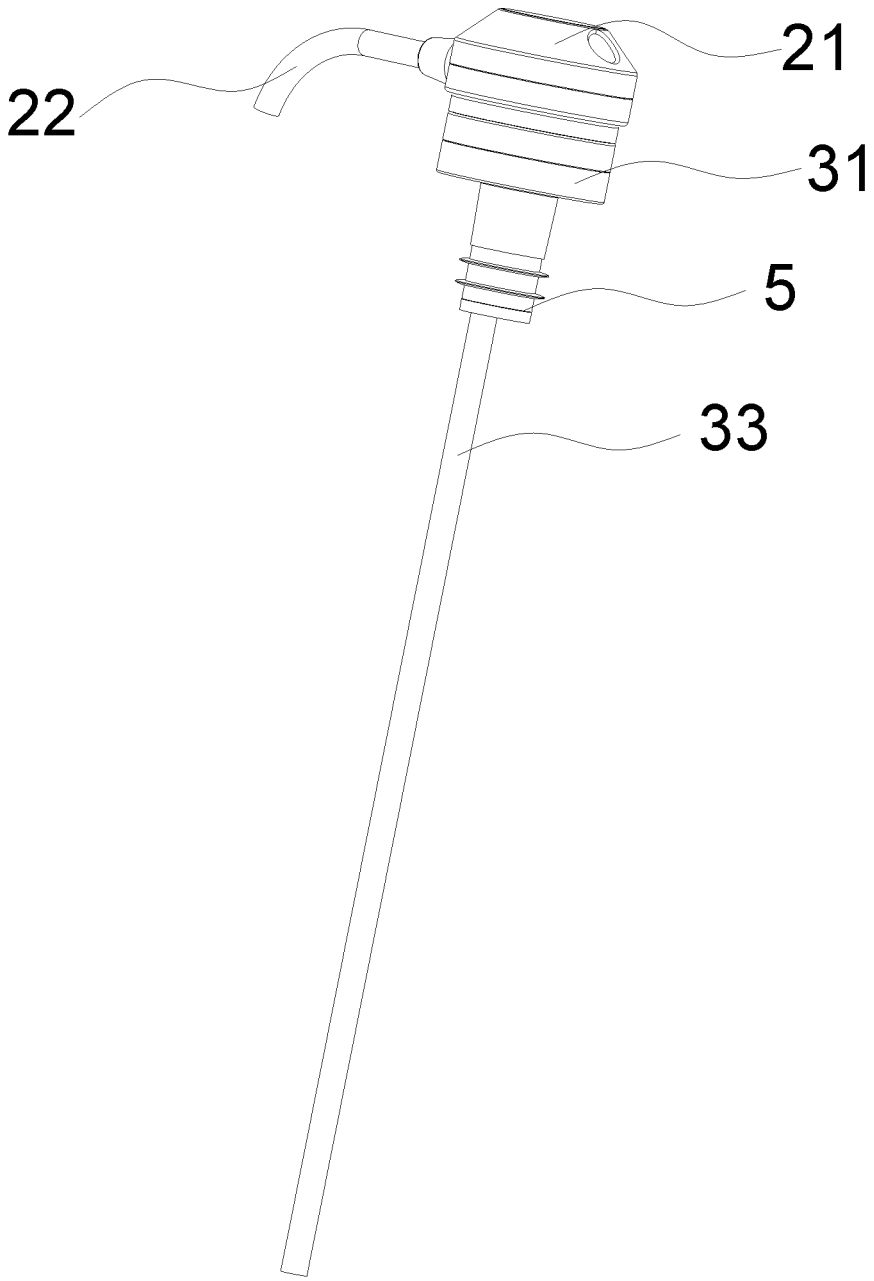
FIG. 4 shows the stereoscopic diagram of a sealing assembly of the separable beverage freshness preserver according to Embodiment 1 of the invention.
Figure 5:
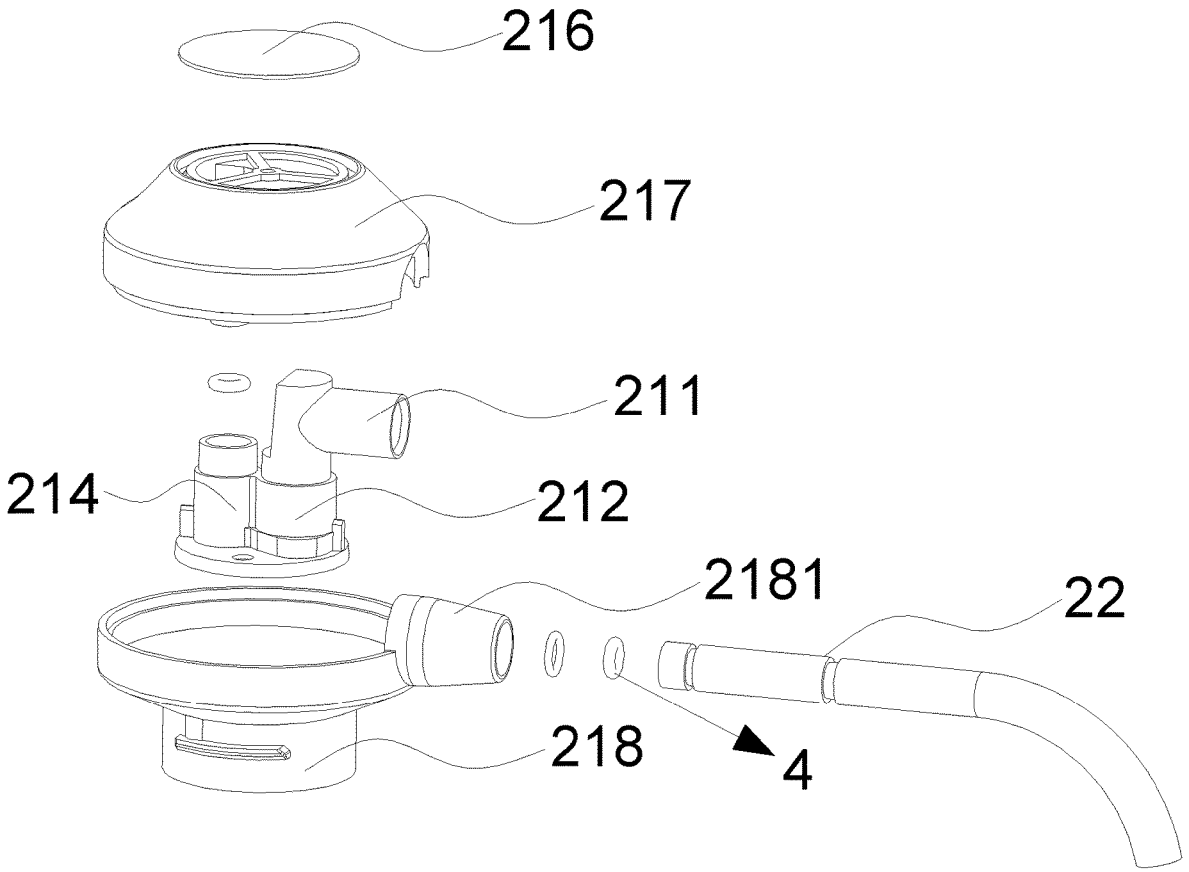
FIG. 5 shows the explosive view of a liquid guiding assembly of the separable beverage freshness preserver according to Embodiment 1 of the invention.
Figure 6:
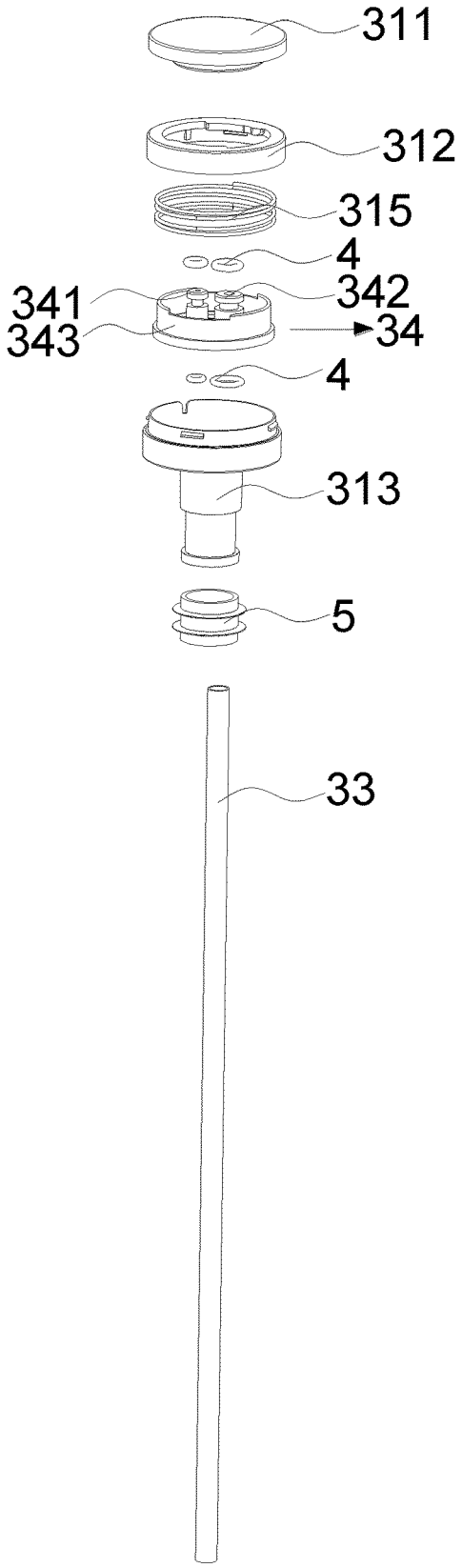
FIG. 6 shows the explosive view of a bottle stopper assembly of the separable beverage freshness preserver according to Embodiment 1 of the invention.
Figure 7:
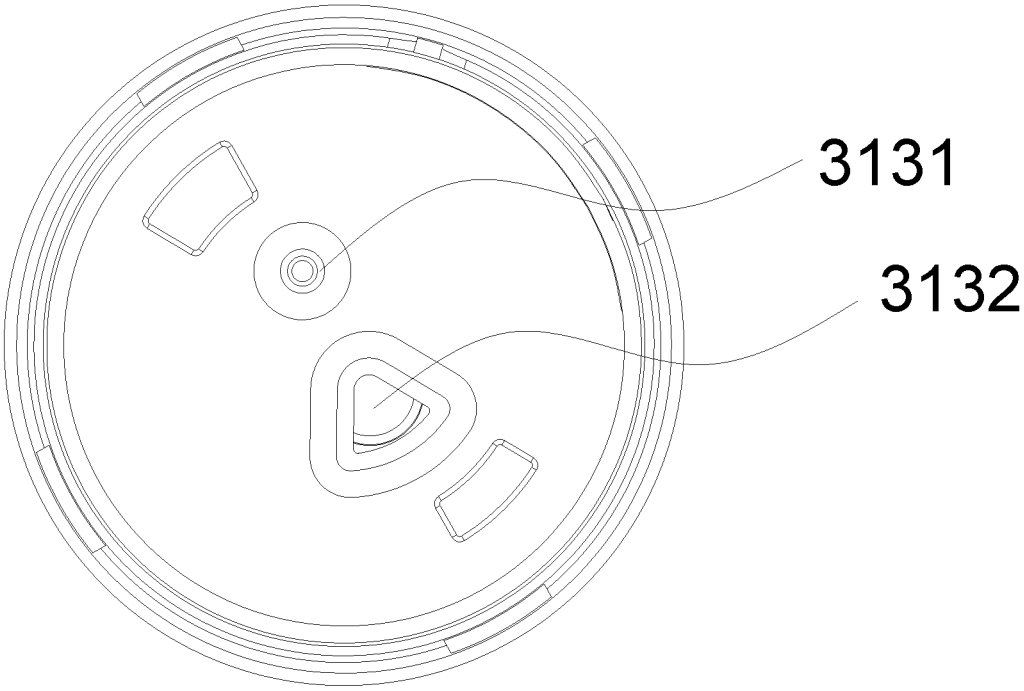
FIG. 7 shows the top view of a lower bottle stopper of the separable beverage freshness preserver according to Embodiment 1 of the invention.
Figure 8:
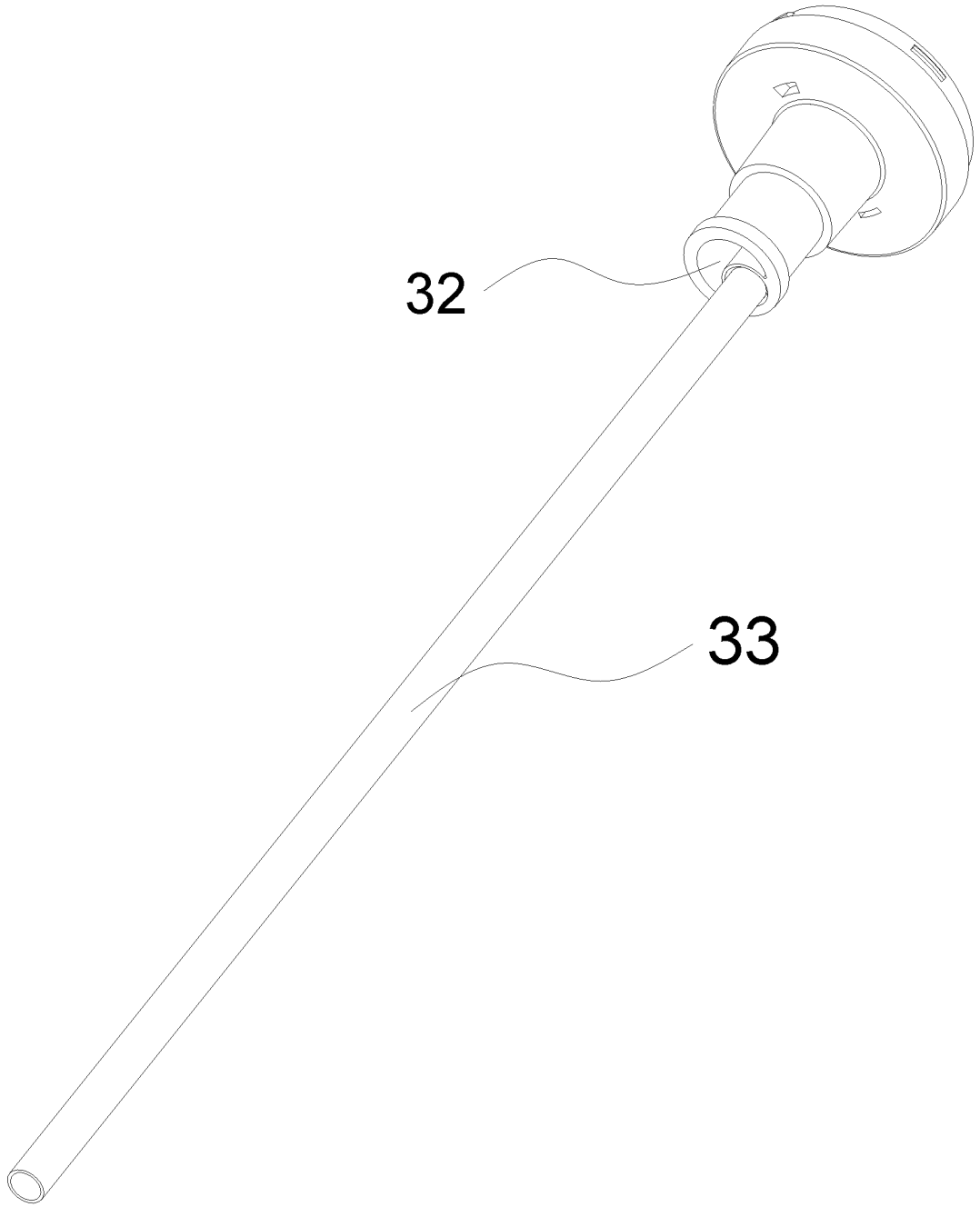
FIG. 8 shows the stereoscopic diagram of the lower bottle stopper of the separable beverage freshness preserver according to Embodiment 1 of the invention.
Figure 9:
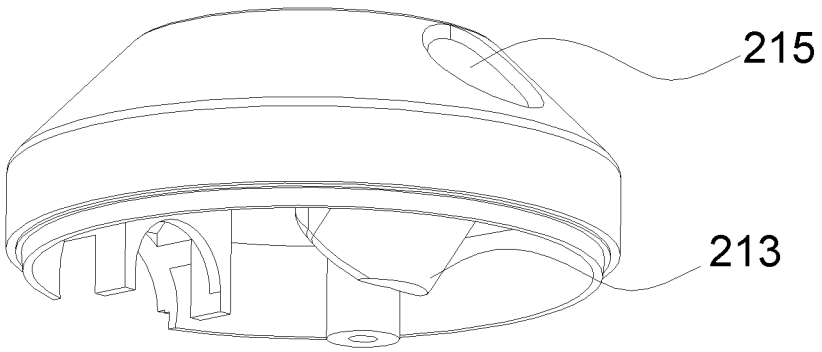
FIG. 9 shows the stereoscopic diagram of an upper screw cap of the separable beverage freshness preserver according to Embodiment 1 of the invention.

As shown in FIGS. 4-5 and 9, the liquid guiding assembly 2 includes a cock 21 and a liquid dispensing pipe 22 connected with the cock 21, and the liquid dispensing pipe 22 is detachably connected with the cock 21; further, the cock 21 is provided with a liquid dispensing passage 211, and one end of the liquid dispensing pipe 22 is detachably arranged in the liquid dispensing passage 211; a liquid outlet passage 212 is formed in the cock 21, and the liquid dispensing passage 211 communicates with the liquid outlet passage 212; and the cock 21 is further provided with a gas guiding passage 213, a gas inlet passage 214 and a gas guiding hole 215 communicating with the gas guiding passage 213, the upper side of the gas guiding passage 213 is detachably connected with the gas outlet pipe 12 via the gas guiding hole 215, and the lower end of the gas guiding passage 213 is connected with the gas inlet passage 214; preferably, the liquid outlet passage 212, the liquid dispensing passage 211 and the gas inlet passage 214 are integrally formed; and in addition, a sealing device 4 is also arranged at the end portion, in contact with the liquid dispensing passage 211, of the liquid dispensing pipe 22 so as to prevent liquid flowing through from overflowing out of the outer surface of the liquid dispensing pipe 22 and prevent a case that after a long time, the overflowing liquid is mildewed to pollute the inside of the cock to further pollute the beverage which needs to be kept fresh. In this embodiment, the cock is a chamber formed by combining an upper cover 216, an upper screw cap 217 and a lower cock 218 from top to bottom, and the liquid dispensing passage 211, the liquid outlet passage 212, the gas guiding passage 213 and the gas inlet passage 214 are all arranged in the chamber of the cock. Specifically, the gas guiding passage 213 is arranged in the upper screw cap 217, the lower cock 218 is also provided with a through pipe 2181, and the liquid dispensing passage 211 and the liquid dispensing pipe 22 are detachably connected inside the through pipe 2181.

As shown in FIG. 4 and FIGS. 6-8, the bottle stopper assembly 3 includes a bottle stopper main body 31, a gas inlet duct 32 and a liquid outlet duct 33 which are connected with the bottom of the bottle stopper main body 1, and a connector 34 arranged inside the bottle stopper main body 31;

The bottle stopper main body 31 structurally includes a dustproof cover 311, an upper plate 312 and a lower bottle stopper 313 from top to bottom, the connector 34 is arranged in a cavity surrounded by the upper plate 312 and the lower bottle stopper 313, the lower end portion of the lower bottle stopper 313 is a cylindrical pipeline, the liquid outlet duct 33 is arranged in the cylindrical pipeline, and the part of the cylindrical pipeline where the liquid outlet duct 33 is removed is the gas inlet duct 32; and the middle portion of the lower bottle stopper 313 is of a plate body structure, and a gas inlet hole 3131 and a liquid outlet hole 3132 are formed at the middle portion of the lower bottle stopper 313 and respectively and correspondingly communicate with the gas inlet duct 32 and the liquid outlet duct 33.

The connector 34 is of an integrally formed structure, and on one side close to the upper plate 312, further includes a gas passing pipe 341 and a liquid passing pipe 342 which communicate up and down; in this embodiment, a sealing device 4 is arranged at the positions of the gas inlet hole and the liquid outlet hole; the lower ends of the gas inlet duct 32 and the liquid outlet duct 33 are inserted into a beverage bottle body 6, and when the freshness preserver is in an opened state, the upper ends of the gas inlet duct 32 and the liquid outlet duct 33 are correspondingly jointed with the gas passing pipe 341 and the liquid passing pipe 342 of the connector 34, and specifically, the upper ends of the gas inlet duct 32 and the liquid outlet duct 33 are correspondingly jointed with the gas passing pipe 341 and the liquid passing pipe 342 via the gas inlet hole 3131 and the liquid outlet hole 3132.

The upper ends of the gas passing pipe 341 and the liquid passing pipe 342 are respectively and detachably connected with the bottoms of the gas inlet passage 214 and the liquid outlet passage 212 of the liquid guiding assembly 2, and in this embodiment, the gas passing pipe 341 and the liquid passing pipe 342 are respectively inserted in the gas inlet passage 214 and the liquid outlet passage 212, and a sealing device 4 is arranged on the surfaces, respectively in inserted connection with the gas inlet passage 214 and the liquid outlet passage 212, of the gas passing pipe 341 and the liquid passing pipe 342; and based on the connecting structure above, the cock 21 can drive the connector 34 to rotate, and rotation of the connector can enable the gas passing pipe 341 and the liquid passing pipe 342 to be correspondingly jointed with the gas inlet hole 3131 and the liquid outlet hole 3132 and enable the bottom plate of the connector to seal up the gas inlet hole 3131 and the liquid outlet hole 3132 so as to achieve an effect of opening and closing the gas inlet hole 3131 and the liquid outlet hole 3132 when the liquid guiding assembly 2 is rotated.

The connector 34 further includes a side plate 343, and a pressure part 315 is arranged on the periphery of the side plate 343. In this embodiment, the pressure part 315 is a spring; one end of the spring abuts against the upper plate 312, while the other end abuts against the bottom plate 344 of the connector 34; the elastic force of the spring forces the bottom plate 344 of the connector 34 to compress down the sealing device 4, so that the sealing device 4 is tightly attached to a plate body of the middle portion of the lower bottle stopper 313; it should be noted that in different embodiments, in order to enable the sealing device 4 to be tightly attached to the middle portion of the lower bottle stopper 313, in addition to use of the spring, the technical effect of sealing also can be achieved by adhering the sealing device 4 in a sealing mode to the middle portion of the lower bottle stopper 313; and moreover, the pressure part 315 also may be a spring sheet and the like.

Further, a sealing plug 5 is arranged on the periphery of a cylindrical barrel of the lower bottle stopper 313, and when the freshness preserver is in a use state, the sealing plug is tightly attached to a beverage bottle opening to prevent gas and liquid inside from overflowing and meanwhile, prevent outside gas, other liquid and the like from entering.

Figure 10:
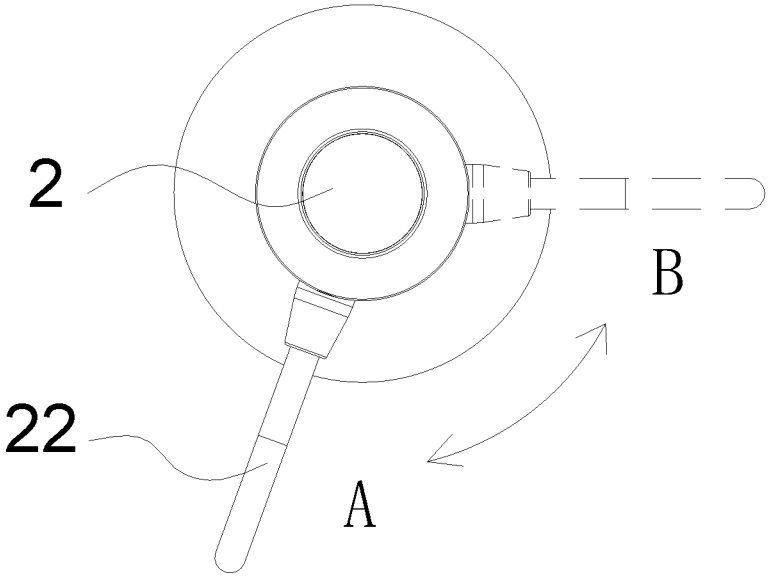
FIG. 10 shows the schematic diagram of a using state of opening and closing a liquid outlet hole and a gas inlet hole of the separable beverage freshness preserver according to Embodiment 1 of the invention.
Figure 11:
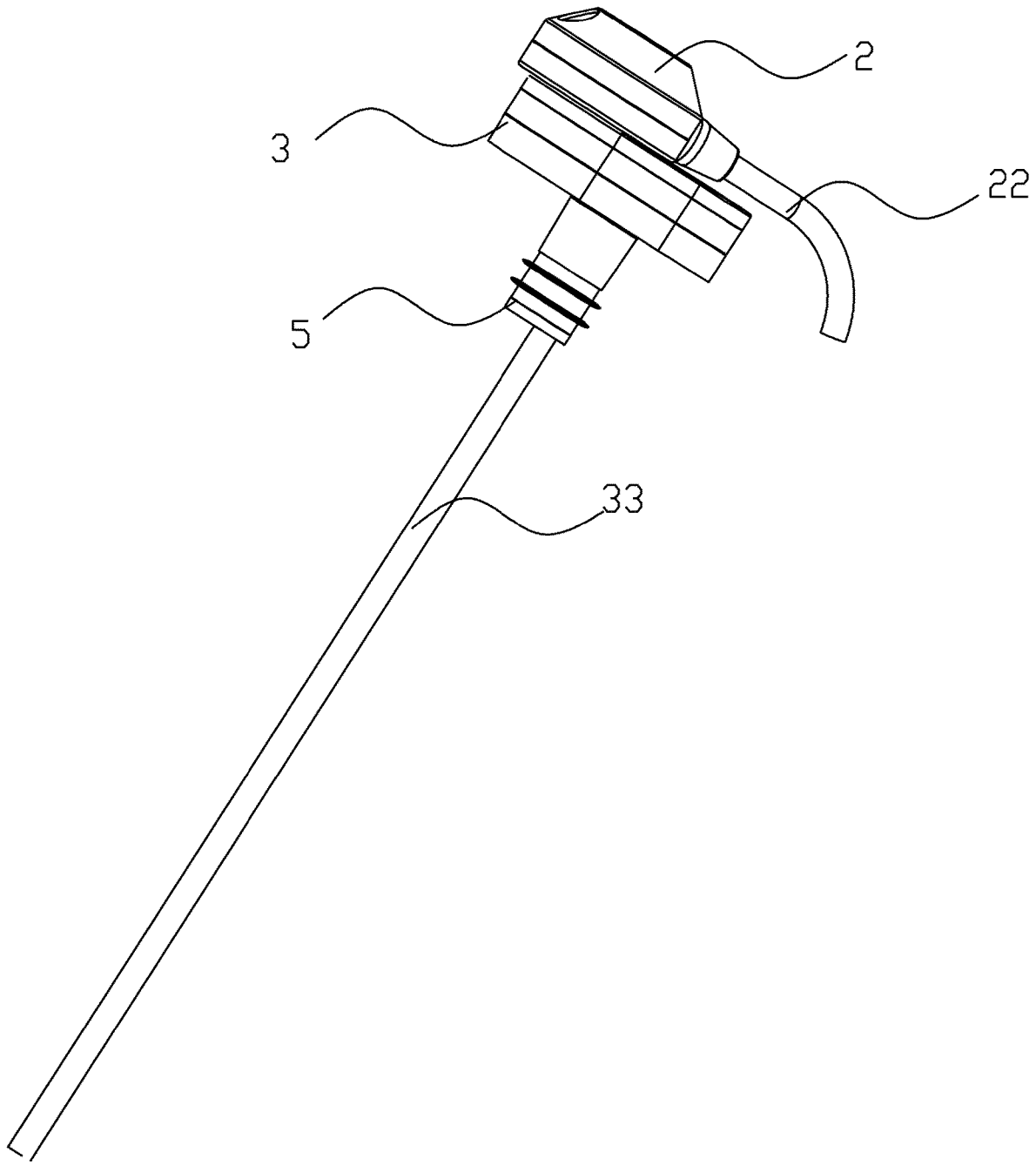
FIG. 11 shows the stereoscopic diagram of a sealing assembly of a separable beverage freshness preserver according to Embodiment 2 of the invention.
Figure 12:
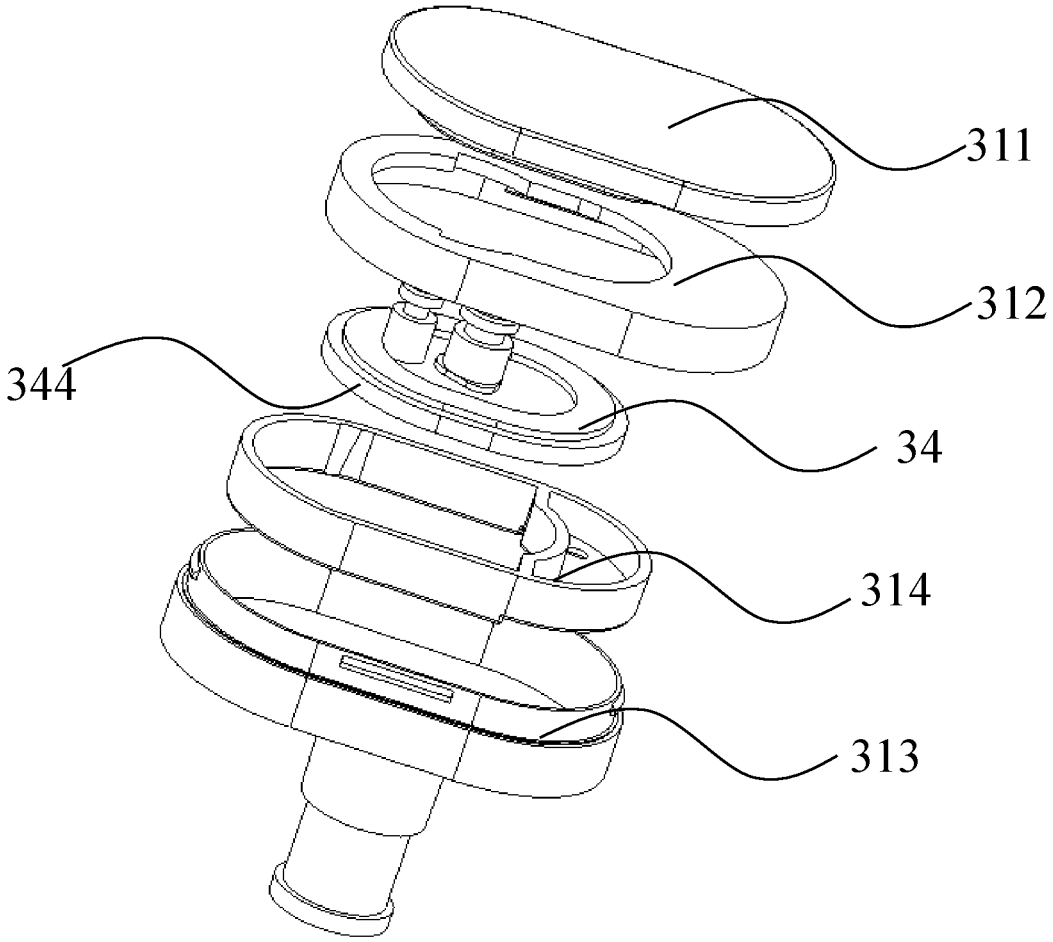
FIG. 12 shows the explosive view of a bottle stopper opening assembly (partially) of the separable beverage freshness preserver according to Embodiment 2 of the invention.

As shown in FIG. 10, when the beverage freshness preserver provided by this embodiment is used for the first time, a self-assembly bottle cap of a beverage is screwed off, the liquid guiding assembly 2 is rotated, the freshness preserver is adjusted into an opened state, at the moment, the liquid dispensing pipe 22 of the liquid guiding assembly 2 is positioned at the position A in the drawing and is mounted on the beverage bottle body 6, when the handle 1121 of the gas outlet assembly 1 is pressed, the inert gas in the gas outlet bottle body 111 is discharged via the gas outlet pipe 12, the inert gas is finally pumped into the bottle body 6 after passing through the gas guiding passage 213, the gas inlet passage 214, the gas passing pipe 341 and the gas inlet duct 32, and at the moment, the gas pressure in the bottle body is higher than the atmospheric pressure of the outside, and thus, the beverage flows out via the liquid dispensing pipe 22 after passing through the liquid outlet duct 33, the liquid passing pipe 342, the liquid outlet passage 212 and the liquid dispensing passage 211; and after the freshness preserver is used, the liquid guiding assembly 2 is rotated, specifically, the cock 21 is rotated to drive the connector 34 to rotate, the bottom plate of the connector 34 rotates along with it and seals up the gas inlet hole 3131 and the liquid outlet hole 3132, at the moment, the liquid dispensing pipe 22 of the liquid guiding assembly 2 is positioned at the position B in the drawing, at the moment, the gas outlet assembly 1 and the liquid dispensing pipe 22 can be pulled out to be separated from the freshness preserver, at the moment, the cock 21 of the liquid guiding assembly 2 can also be pulled out of a cock assembly 3, only the bottle stopper assembly is left on a beverage bottle, the beverage bottle is covered with the dustproof cover 311 for sealing so as to prevent the air outside from being in contact with the beverage, at the moment, due to the inert gas filled in the beverage bottle, the high deterioration speed of the beverage can be prevented, and the gas out assembly 1, the liquid dispensing pipe 22 and the cock 21 can be separated from the bottle body, and thus, the beverage can be placed in a place with a narrow space, such as a refrigerator and the like, and occupies a small space so as to facilitate refrigeration and preservation.

Embodiment 2

FIGS. 11-15 show Embodiment 2 of the invention. It should be illustrated herein that Embodiment 2 is merely different from Embodiment 1 in the following contents, and the rest of part structures, names of the parts and connection relationships of the parts are all consistent, and thus, the specific parts included by Embodiment 2, the names of the parts and the connection relationships are not repeated again, and the reference sign of each part in the drawings of Embodiment 2 is not changed and is consistent with that in Embodiment:

1. As shown in FIGS. 11-15, the movement relationship of the liquid guiding assembly 2 relative to the bottle stopper assembly 3 is not rotating movement, but small-range displacement in the horizontal direction along the bottle stopper assembly 3. Specifically, when the freshness preserver is in use, the cock 21 on the liquid guiding assembly 2 is pulled along A in the horizontal direction, and the cock 21 drives the connector 34 to move in the horizontal direction, so that the gas passing pipe 341 and the liquid passing pipe 342 respectively correspond to the gas inlet hole 3131 and the liquid outlet hole 3132, and the gas inlet hole 3131 and the liquid outlet hole 3132 are opened; when the beverage is preserved after the freshness preserver is used, the cock 21 is pulled along B in the horizontal reverse direction, and the cock 21 drives the connector 34 to move in the horizontal reverse direction, so that the gas inlet hole 3131 and the liquid outlet hole 3132 are closed; and meanwhile, for cooperating with the horizontal movement of the liquid guiding assembly 2, the shape of the bottle stopper assembly 3 is designed to be greater than that of the liquid guiding assembly 2 in terms of width in the horizontal direction with respect to the bottle stopper assembly in Embodiment 1.

Figure 13:
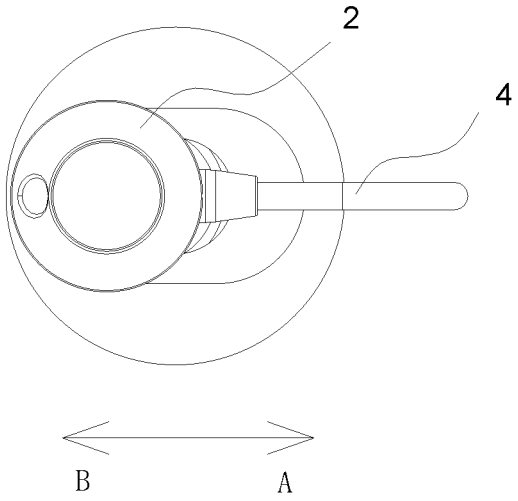
FIG. 13 shows the schematic diagram of a using state of opening and closing a liquid outlet hole and a gas inlet hole of the separable beverage freshness preserver according to Embodiment 2 of the invention.
Figure 14:
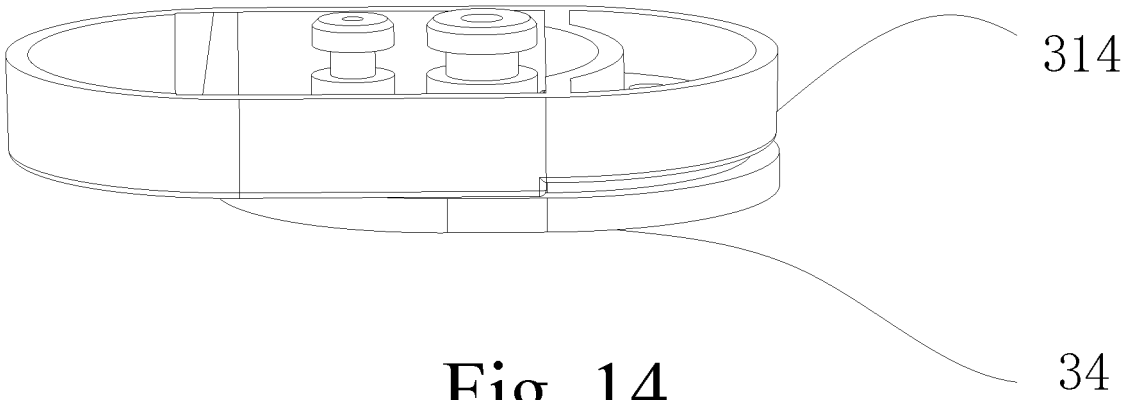
FIG. 14 shows the stereoscopic diagram of a pressure part and a connector when the separable beverage freshness preserver is in an opened state according to Embodiment 2 of the invention.
Figure 15:
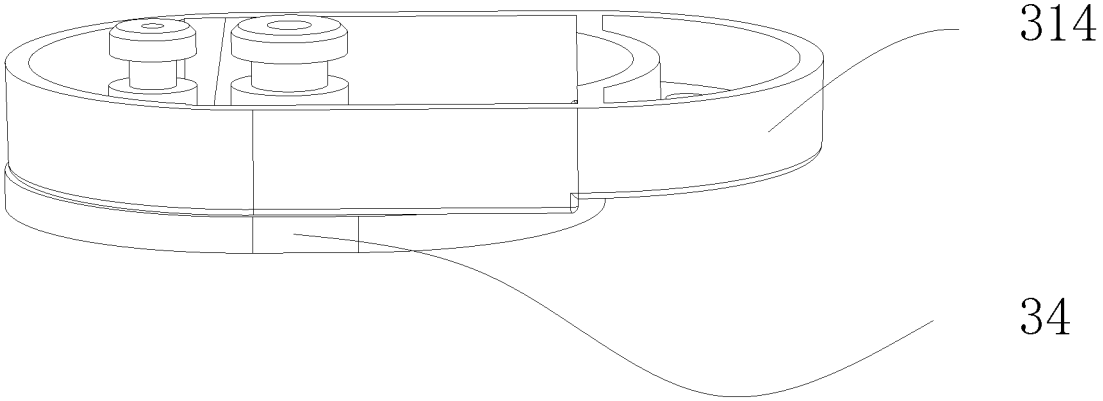
FIG. 15 shows the stereoscopic diagram of the pressure part and the connector when the separable beverage freshness preserver is in a closed state according to Embodiment 2 of the invention.

2. The connector 34 does not include the side plate, and only includes the bottom plate 344; and 3. The pressure part 315 is a ring-shaped elastic rubber mat and sleeved with the lower bottle stopper 313, and one end of the ring-shaped elastic rubber mat abuts against the upper plate 312, while the other end abuts against the bottom plate of the connector 34; the pressure part forces the bottom plate 344 of the connector 34 to compress down the sealing device 4, then the sealing device 4 is tightly attached to the plate body of the middle portion of the lower bottle stopper 313, and as shown in FIGS. 13-15, when the cock 21 of the liquid guiding assembly 2 is pulled to move along the A or B direction, the pressure part 315 always compresses the connector 34.

From the above, according to the invention, the gas outlet assembly 1, the liquid guiding assembly 2 and the cock assembly 3 are detachable and separable, and when the beverage is preserved, only the bottle stopper is reserved, so that the weight and the volume of the device are greatly lightened and reduced, the risk of dumping is avoided, the separable beverage freshness preserver can be placed into a refrigerated cabinet for storage, and safety and convenience of use are improved. In addition, a plurality of bottle stopper assemblies 3 and gas outlet assemblies 1 can be replaced with the liquid guiding assembly 2 of the separable beverage freshness preserver, and the liquid guiding assembly 2 can be repeatedly used.

According to the disclosure and instruction of the specification above, those skilled in the art of the invention also can make changes and modifications to the embodiments above. Therefore, the invention is not limited to the specific embodiments disclosed and described above, and some modifications and changes made to the invention also shall fall within the scope of protection of claims of the invention. In addition, some specific terms are used in this specification, but these terms are for convenience of illustration only and do not constitute any limitation to the present invention.

The invention claimed is:

1. A bottle stopper assembly (3), comprising a bottle stopper main body (31), a gas inlet duct (32) and a liquid outlet duct (33) which are connected with a bottom of the bottle stopper main body (31), and a connector (34) arranged inside the bottle stopper main body (31);

wherein the bottle stopper main body (31) structurally comprises a dustproof cover (311), an upper plate (312) and a lower bottle stopper (313) from top to bottom, and the connector (34) is arranged in a cavity surrounded by the upper plate (312) and the lower bottle stopper (313);

a lower end portion of the lower bottle stopper (313) is a cylindrical pipeline, the liquid outlet duct (33) is arranged in the cylindrical pipeline, and a part of the cylindrical pipeline where the liquid outlet duct (33) is removed is the gas inlet duct (32); and a middle portion of the lower bottle stopper (313) is of a plate body structure, and a gas inlet hole (3131) and a liquid outlet hole (3132) are arranged at the middle portion of the lower bottle stopper (313) and respectively and correspondingly communicate with the gas inlet duct (32) and the liquid outlet duct (33).

2. The bottle stopper assembly (3) according to claim 1, wherein the connector (34) is of an integrally formed structure, and on one side close to the upper plate (312), further comprises a gas passing pipe (341) and a liquid passing pipe (342) which communicate up and down.

3. The bottle stopper assembly (3) according to claim 2, wherein a sealing device (4) is arranged at positions of the gas inlet hole (3131) and the liquid outlet hole (3132);

the connector (34) further comprises a side plate (343) and a bottom plate (344), a pressure part (315) is arranged on a periphery of the side plate (343), and one end of the pressure part (315) abuts against the upper plate (312), while another end abuts against the bottom plate (344) of the connector (34); and a sealing plug (5) is arranged on a periphery of the cylindrical pipeline of the lower bottle stopper (313).

4. The bottle stopper assembly (3) according to claim 2, wherein a sealing device (4) is arranged at positions of the gas inlet hole (3131) and the liquid outlet hole (3132);

a pressure part (314) is sleeved with the lower bottle stopper (313), and one end of the pressure part (314) abuts against the upper plate (312), while another end abuts against the bottom plate (344) of the connector (34); and a sealing plug (5) is arranged on a periphery of the cylindrical pipeline of the lower bottle stopper (313).

5. A separable beverage freshness preserver, comprising a gas outlet assembly (1) and a sealing assembly connected with the gas outlet assembly, wherein the sealing assembly comprises a liquid guiding assembly (2) and the bottle stopper assembly (3) according to claim 1 connected with the liquid guiding assembly (2);

the liquid guiding assembly (2) comprises a cock (21) and a liquid dispensing pipe (22) connected with the cock (21); and the liquid dispensing pipe (22) is detachably connected with the cock (21).

6. The separable beverage freshness preserver according to claim 5, wherein the cock (21) is provided with a liquid dispensing passage (211), and one end of the liquid dispensing pipe (22) is detachably arranged in the liquid dispensing passage (211);

a liquid outlet passage (212) is arranged in the cock (21), and the liquid dispensing passage (211) communicates with the liquid outlet passage (212); and the cock (21) is further provided with a gas guiding passage (213), a gas inlet passage (214) and a gas guiding hole (215) communicating with the gas guiding passage (213), and a lower end of the gas guiding passage (213) is connected with the gas inlet passage (214).

7. The separable beverage freshness preserver according to claim 6, wherein the gas outlet assembly (1) comprises a gas outlet bottle (11) and a gas outlet pipe (12) connected with the gas outlet bottle (11), and the gas outlet pipe (12) is detachably connected with an upper end of the gas guiding passage (213), via the gas guiding hole (215); and the gas outlet bottle (11) further comprises a gas outlet bottle body (111) filled with gas and an inflating part (112), the inflating part (112) is squeezed into the gas outlet bottle body (111), and a handle (1121) is also arranged on an upper side of the inflating part (112);

upper ends of the gas passing pipe (341) and the liquid passing pipe (342) are respectively and detachably connected with bottoms of the gas inlet passage (214) and the liquid outlet passage (212) of the liquid guiding assembly (2); and a sealing device (4) is arranged on surfaces, respectively connected with the gas inlet passage (214) and the liquid outlet passage (212), of the gas passing pipe (341) and the liquid passing pipe (342).

8. The separable beverage freshness preserver according to claim 6, wherein the liquid outlet passage (212), the liquid dispensing passage (211) and the gas inlet passage (214) are integrally formed; and a sealing device (4) is also arranged at an end portion, in contact with the liquid dispensing passage (211), of the liquid dispensing pipe (22).

9. The separable beverage freshness preserver according to claim 6, wherein the cock (21) is a chamber formed by combining an upper cover (216), an upper screw cap (217) and a lower cock (218) from top to bottom, and the liquid dispensing passage (211), the liquid outlet passage (212), the gas guiding passage (213) and the gas inlet passage (214) are all arranged in the chamber of the cock (21); and the gas guiding passage (213) is arranged in an upper screw cap (217); and the lower cock (218) is also provided with a through pipe (2181), and the liquid dispensing passage (211) and the liquid dispensing pipe (22) are detachably connected inside the through pipe (2181).

* * * * *